US005569145A

United States Patent [19]

Achelpohl et al.

[11] Patent Number: 5,569,145

[45] Date of Patent: Oct. 29, 1996

[54] METHOD AND APPARATUS FOR MANUFACTURING A SACK BOTTOM

[75] Inventors: Fritz Achelpohl, Lienen; Richard Feldkämper, Lengerich, both of Germany

[73] Assignee: Windmoller & Holscher, Lengerich, Germany

[21] Appl. No.: 285,468

[22] Filed: Aug. 3, 1994

[30] Foreign Application Priority Data

Aug. 4, 1993 [DE] Germany ..... 43 26 188.4

[51] Int. Cl.[6] ..... B31B 21/00

[52] U.S. Cl. ..... 493/240; 493/248; 493/260; 493/264

[58] Field of Search ..... 493/189, 192, 493/205–209, 240–245, 248, 260, 264–266

[56] References Cited

U.S. PATENT DOCUMENTS

| | | | |
|---|---|---|---|
| 2,851,934 | 9/1958 | Heywood | 493/248 |
| 3,077,821 | 2/1963 | Sauerman | 493/265 |
| 3,664,238 | 5/1972 | Baxter | 493/241 |
| 3,712,185 | 1/1973 | Falasconi | 493/265 |
| 3,868,894 | 3/1975 | Watson | 493/265 |
| 3,990,354 | 11/1976 | Ward | 493/265 |

FOREIGN PATENT DOCUMENTS

4142824A1 6/1993 Germany .

*Primary Examiner*—Jack W. Lavinder
*Attorney, Agent, or Firm*—Keck, Mahin & Cate

[57] ABSTRACT

The invention concerns a method and an apparatus for manufacturing a bag or sack bottom from tubular sections of paper or plastic web. Tubular sections of web material are fed into a feeding plane where they are subsequently sealed along selected seams by a sealing means. The sections are then inverted and fed in parallel to a scoring, gluing and folding section. The tubular section is then inverted again and passed to a pressing section. The tubular sections are stacked on top of each other in a partially overlapping manner as they are passed through the pressing section. After pressing, the tubular sections are passed to a separating station for again separating them before being passed to a packaging station. The invention concerns, moreover, an apparatus for operating the above mentioned method.

6 Claims, 2 Drawing Sheets

METHOD AND APPARATUS FOR MANUFACTURING A SACK BOTTOM

FIELD OF THE INVENTION

The invention concerns a method and an apparatus for manufacturing a bag or sack bottom. In this application the word sack is used throughout to refer to the items processed and produced by the present invention.

PRIOR ART

Automatic methods for forming sack bottoms on single and multilayer tubular sections of paper or plastic web are already known. With the prior art, because several individual processing stations are required, the apparatus used is necessarily long.

OBJECTS OF THE INVENTION

It is an object of the present invention to provide a method for manufacturing a leakproof sack bottom which facilitates an apparatus for manufacturing the sack bottom which has a compact design.

SUMMARY OF THE INVENTION

According to the present invention there is provided a method for the manufacture of a bag or sack bottom comprising the following steps:

a) feeding a multilayer tubular section in a feeding plane, b) sealing predetermined sealing seams, c) inverting the tubular section and feeding it parallel to the feeding plane into a processing plane wherein the tubular section is scored, glued and folded together, d) again inverting the tubular section which is now closed at one end and conveying it parallel to the feeding plane through a pressing section in an overlapping manner.

e) separating the tubular sections into individual units in a separating station, and f) feeding it to a packaging station.

An important feature of this method lies in the fact that the manufacture of the sack bottom is effected in three planes arranged on top of one another namely: the feeding plane, the processing plane and the plane of the pressing section. As a result, the whole apparatus for carrying out the method is of a shorter and more compact design than the prior art.

Advantageously, the tubular sections to be closed, which are at first still open at both ends, are fed longitudinally into the feeding plane and then turned by means of a turning station, already known per se from the DE-A1-4142824, through 90° in such a way that they are passed on sideways. Thus, the method here claimed can directly follow a method for the manufacture of the tubular sections.

It is beneficial if sections comprising multilayer tubular webs with side folds are supplied for each sack, wherein the outer tubular web has a projecting flap that extends over its full width and wherein at least one of the inserted tubular webs with side folds terminates at the outer edge of the flap. After suitable preliminary scoring and formatted glue application, firstly the one inner tubular web with side folds is folded over and glued to the outer side of the outer tubular web with side folds, during which process the flap of the outer tubular web with side folds remains in position. Subsequently, after an appropriate formatted gluing of the inner side of the flap of the outer tubular web with side folds, and the outer side of the folded-over inner tubular web with side folds, one proceeds once more with folding round the outer edge of the folded-over inner tubular web with side folds. Then the inner side of the flap of the outer tubular web with side folds and the outer side of the folded-over inner tubular web with side folds are glued to the outer side of the outer tubular web with side folds.

The sacks thus formed, being closed only on one end are delivered in this form to the user. They are, for example, employed for use in a filling apparatus for bulk material wherein after being filled, the still open end is closed by a known method.

The invention also provides an apparatus for manufacturing a sack bottom, by the use of one of the above mentioned methods, and with a turning station, a sealing and inverting cylinder disposed down line thereof, at least one scoring station, at least one glue application station and at least one folding station in a processing plane extending parallel to the feeding plane, an inverting station following thereon, pressing section extending in a further plane that is parallel to the feeding plane and the processing plane, a separating station disposed down line thereof, and a packaging station.

If required, there may also be a station for aligning the tubular sections in the feeding plane, that is to say, in a first tier of the apparatus.

The alignment station serves to ensure that the sack sections are fed parallel and exactly aligned to the sealing station and subsequently to the further processing stations. The sealing of the sealing seams is effected by a sealing cylinder which serves at the same time as an inverting cylinder. By means of this sealing and inverting cylinder, the tubular sections are transferred into the second tier of the apparatus, the so-called processing plane. In the processing plane the tubular sections pass through at least one scoring station, at least one glue application station and at least one folding station. Thereupon they pass through a further inverting station which conveys them to a third tier of the apparatus which also comprises a plane disposed parallel to the feeding plane and the processing plane. In this uppermost plane, the folded and glued sack sections pass through a pressing section.

The sack sections are conveyed overlapped with each other between two belts and are therein pressed together during conveying for a sufficiently long period of time that the applied glue has largely set. After passing through the pressing section, the sacks pass in their overlapped formation into an overlap separating station which separates the individual sacks and feeds them into a suitable packaging station.

The apparatus is preferably provided with a first and a second scoring station comprised of appropriate scoring disk-pairs arranged in the processing plane, and that there follows a first glue application station and a first folding station and that there further follows a second glue application station and a second folding station.

BRIEF DESCRIPTION OF THE DRAWINGS

The method and apparatus of the present invention will now be described by way of example only, with reference to the accompanying drawings in which.

DETAILED DESCRIPTION OF THE PREFERRED EMBODIMENT

Figure 1:
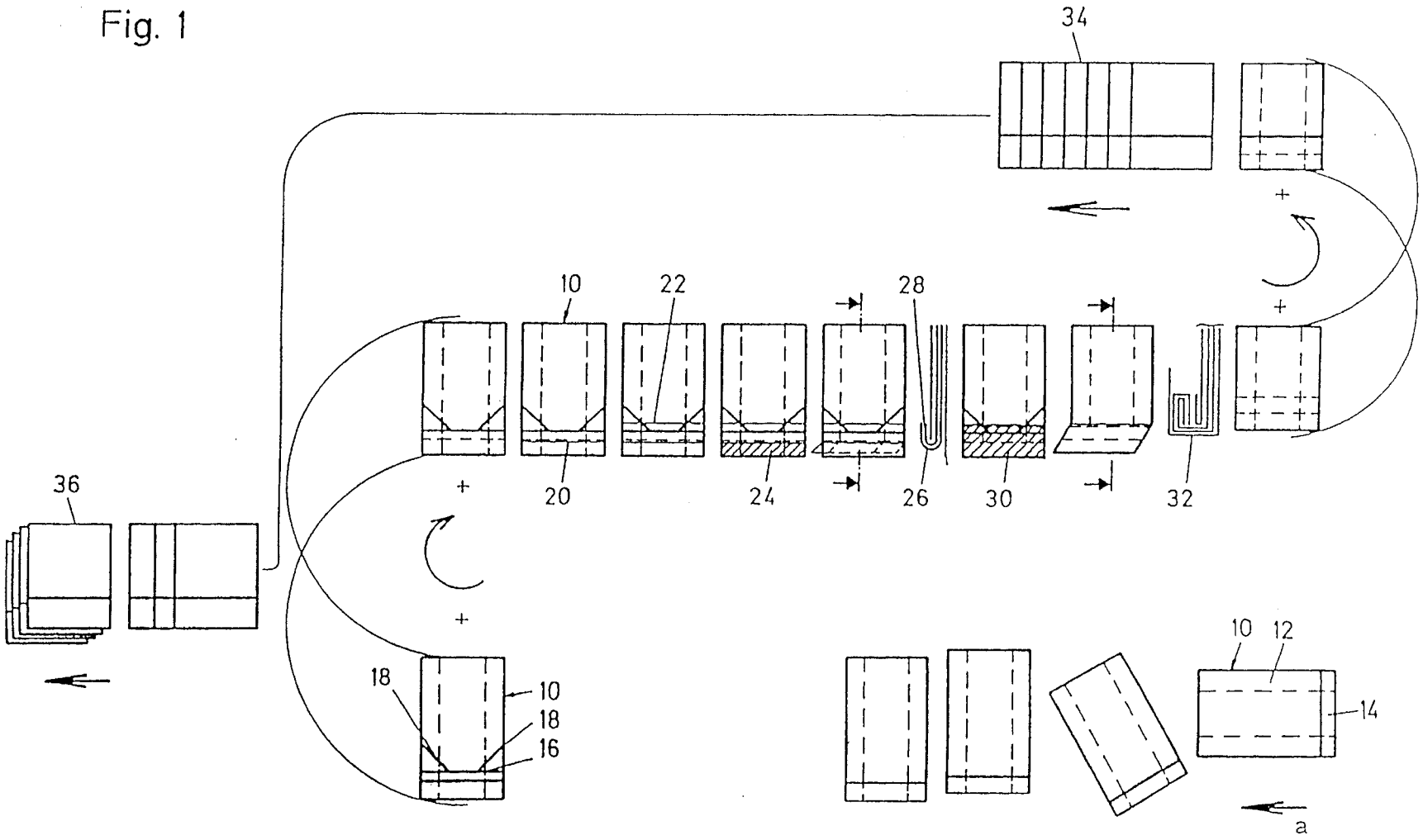
FIG. 1 is a schematic flow diagram of the method, by means of which the individual processing steps of the method in accordance with the present invention are explained.

In FIG. 1, 10 designates a two-layer tubular section which consists of two tubular web sections with side folds 12 that have been inserted one into the other. The side folds 12 are indicated by dashed lines. The outer tubular web with side folds has a flap 14 extending over its width. The inserted inner tubular web with side folds terminates with the outer edge of the flap.

At first the tubular web sections 10 with side folds travel in a longitudinal direction in the direction of arrow a, as represented in FIG. 1. In a first station, the tubular webs with side folds are turned through 90°. Subsequently, they are aligned so that they are carried parallel to each other. This turning and alignment is effected in one plane, the so-called feeding plane. After the tubular web sections 10 with side folds have been aligned, they are provided with sealing seams 16 and 18 in a sealing station. The sealing seam 16 extends transversely across the sack and the sealing seams 18 are corner sealing seams. The application of such sealing seams in a sealing station is already well known in the art.

Subsequently, the sealed tubular web sections 10 with side folds are turned through 180° and are delivered to a second plane, the so-called processing plane. Here the future fold lines 20 and 22 are prescored in two successive operating steps. Then the upper end portion of the inner tubular web with side folds is at first provided with a formatted glue application 24 before being folded over along the prescored fold line 20, so that the first folded edge 26 is obtained which is represented in FIG. 1 as a top view during the folding and as a sectional representation after the folding. The outer edge of the inner tubular web 28 with side folds lies on the second prescored folded line 22. Subsequently, the inner fold of the flap of the outer tubular web with side folds and the outer side of the folded-over inner tubular web with side folds are provided with a formatted glue application 30 and folded over the fold line 22, so that the folded edge 32 is obtained.

The tubular web sections 10 with side folds are again turned and are carried in the form of an overlapped stack 34 through a pressing section wherein each folded sack bottom is held in the desired shape for a time sufficient to allow the glue to set. In a separating station, the tubular sections 10 deposited in an overlapping formation are then separated into individual units and are fed to a packaging section, so that they can be stacked in suitable packet stacks 36. The three operating planes for the feeding, processing and pressing are characteristic of the method herein represented.

Figure 2:
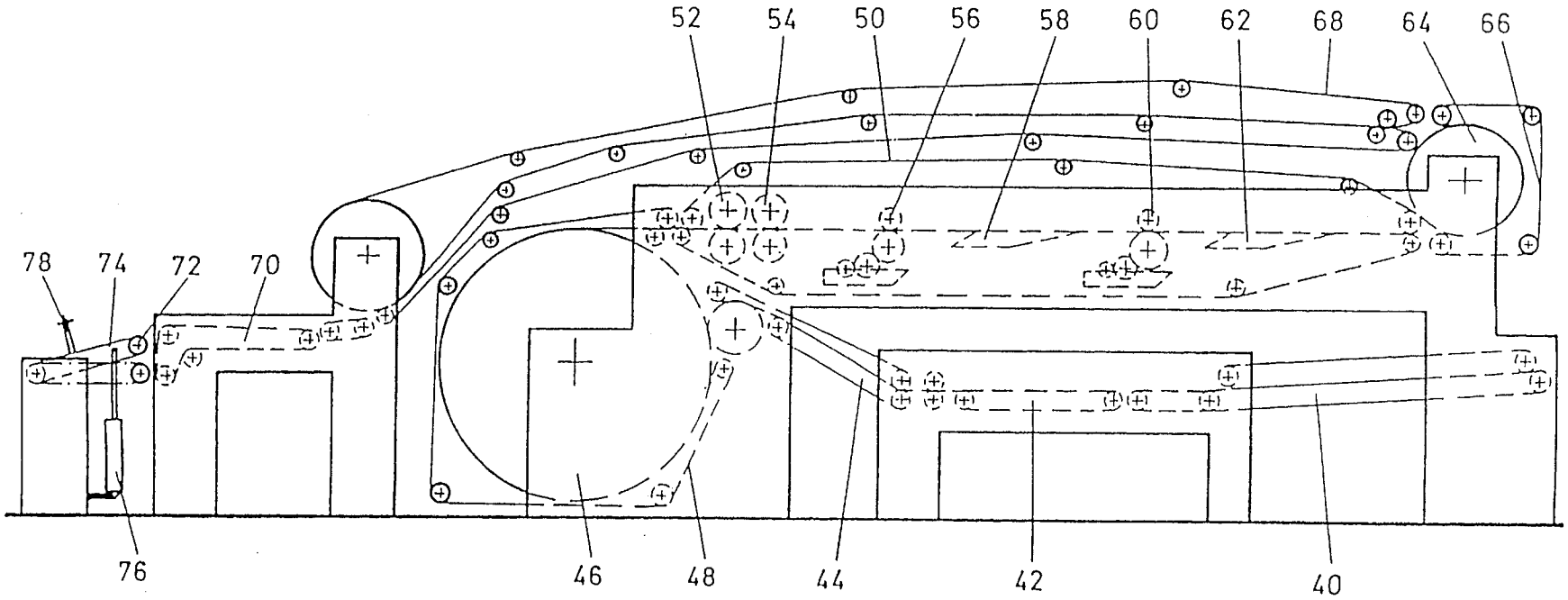
FIG. 2 is a schematic side view of an apparatus for carrying out the method in accordance with the present invention.

The appropriate arrangement of the operating planes facilitate a compact design of the apparatus, as schematically represented in FIG. 2. In the feeding plane, a turning station 40 is first schematically represented which consists in essence of belt- pairs running on top of one another, between which the incoming tubular sections 10 are conveyed. The exact design of the turning station is described in DE-A1-4142824, to the description whereof reference may be made.

The turning station is followed by an alignment station 42, wherein the tubular sections 10 are aligned in such a way that they are carried parallel to one another, and transversely to the conveying direction with respect to their longitudinal axis.

The appropriately arranged tubular sections 10 are fed by suitable conveyor belts 44 to a sealing and inverting cylinder 46 and are held between suitable holding belts 48 and the sealing and inverting cylinder 46. After the tubular sections have been appropriately sealed and inverted by rotation through 180°, they run into the processing plane and are further conveyed by means of appropriate belts 50.

In the processing plane, the tubular sections 10 first pass through two scoring stations consisting of pairs of scoring disks 52 and 54 which are arranged opposite each other. These are followed in the direction of conveying by a first glue application station 56 of a known design, and a first folding station 58 of a known design, followed by a second glue application station 60 and a second folding station 62. The tubular sections 10 with their appropriately folded bottoms are turned through 180° by means of an inverting cylinder 64, in which process, the tubular sections 10 are pressed onto the inverting cylinder 64 by appropriately circulating conveyor belts 66.

The tubular sections 10 leaving the inverting cylinder 64 are seized by a belt-pair 68 which is running at a comparatively slower speed, in such a way that the successively arriving sections 10 are deposited so that they overlap each other. The overlapping tubular sections are pressed between the belt pairs 68, which constitute the pressing section. The pressing section is followed by a separating station 70, in which the overlapping sections delivered are separated into individual units again by belts that are running at a comparatively higher speed, the sections then being fed to a suitable packaging station 72.

The packaging station 72 has a pivotably mounted receiving plane 74 which can be pivoted by means of a piston cylinder arrangement 76 in the way shown in FIG. 2. The sacks are conveyed against a stop 78 until the desired stack of sacks has been piled up. During this stacking action, the bearing surface 74 is lowered. After the desired stacking height has been reached, the stack of sacks is removed and a new stack of sacks is taken up.

We claim:

1. In a method for manufacturing a bag or sack bottom comprising the steps of:

a) feeding multilayer tubular sections in a feeding plane, b) sealing predetermined sealing seams, c) separating the tubular sections into individual units in a separating station, and d) feeding the tubular sections to a packaging station; an improvement comprising the steps of:

e) inverting the tubular sections, feeding the tubular sections parallel to the feeding plane into a processing plane, and scoring, gluing and folding an end of each of the tubular sections being fed in said processing plane; and f) again inverting the tubular sections, each of which is now closed at said end, and conveying the tubular sections parallel to the feeding plane through a pressing section in an overlapping manner with each other.

2. A method according to claim 1, wherein the tubular sections are fed in the feeding plane in their longitudinal directions and are then turned in a turning station through 90°.

3. A method according to claim 1, wherein for each bag or sack there are supplied sections of several tubular webs with side folds comprising an outer tubular web and at least one inserted tubular web, wherein the outer tubular web with side folds has a projecting flap extending across its width, and wherein the at least one inserted tubular web with side folds terminates at the outer edge of the flap; and wherein after a suitable preliminary scoring and formatted glue application, at first the at least one inserted tubular web with side folds is folded over and is glued to the outer side of the outer tubular web with side folds, in which process the flap of the outer tubular web with side folds remains in position; and including the steps of (a) subsequent to an appropriate formatted gluing of the inner side of the flap of the outer tubular web with side folds and the outer side of the folded-over inserted tubular web with side folds, once more folding over the outer edge of the folded-over inserted tubular web with side folds, and (b) gluing the inner side of the flap of the outer tubular web with side folds and the outer side of the folded-over inserted tubular web with side folds to the outer side of the outer tubular web with side folds.

4. An apparatus for manufacturing a bag or sack bottom comprising:

a turning station;

a sealing and inverting cylinder disposed down line thereof;

at least one scoring station;

at least one glue application station and at least one folding station in a processing plane extending parallel to a feeding plane;

an inverting station following said at least one glue application station and folding station;

a pressing section extending in a further plane that is parallel to the feeding plane and the processing plane;

a separating station disposed down line of said pressing station; and a packaging station.

5. An apparatus according to claim 4, and including a first scoring station and a second scoring station arranged in the processing plane and followed by a first glue application station, a first folding station, a second glue application station, and a second folding station respectively, each of said first and second scoring stations comprising a pair of scoring disks.

6. Apparatus according to claim 4, and including means for aligning the tubular sections in said feeding plane.

* * * * *